United States Patent [19]

Paliwal et al.

[11] Patent Number: 4,755,221

[45] Date of Patent: Jul. 5, 1988

[54] ALUMINUM BASED COMPOSITE POWDERS AND PROCESS FOR PRODUCING SAME

[75] Inventors: Muktesh Paliwal, Sayre; Walter A. Johnson, Towanda, both of Pa.

[73] Assignee: GTE Products Corporation, Stamford, Conn.

[21] Appl. No.: 843,440

[22] Filed: Mar. 24, 1986

[51] Int. Cl.[4] ..... C22C 29/14

[52] U.S. Cl. ..... 75/244; 75/254; 419/12; 419/23; 419/31; 419/53; 419/54

[58] Field of Search ..... 75/244, 254; 419/12, 419/23, 31, 53, 54; 420/528, 590

[56] References Cited

U.S. PATENT DOCUMENTS

| | | | |
|---|---|---|---|
| 3,877,884 | 4/1975 | Tawarada et al. | 419/14 |
| 4,492,670 | 1/1985 | Mizrah et al. | 419/12 |
| 4,544,524 | 10/1985 | Mizrah et al. | 419/12 |
| 4,557,893 | 12/1985 | Jatkar et al. | 419/12 |

*Primary Examiner*—Stephen J. Lechert, Jr.
*Attorney, Agent, or Firm*—Donald R. Castle; L. Rita Quatrini

[57] ABSTRACT

Composite powder particles which are essentially spherical in shape are disclosed which consist essentially of particles of a matrix phase which consists essentially of a metal selected from the group consisting of aluminum and aluminum based alloys and a reinforcement phase which is relatively uniformly dispersed in and bonded to the matrix, the reinforcement phase comprising titanium diboride.

A process is disclosed for producing the above composite particles which involves entraining in a carrier gas a plurality of agglomerated powders, at least one of the powders supplying aluminum, at least one of the powders supplying titanium without boron and at least one of the powders supplying boron without titanium. The powders are fed through a high temperature zone to cause essentially complete melting and coalescence of the powders wherein at least a part of the titanium and at least a part of the boron combine to form titanium diboride and thereafter resolidified to form the composite powder particles.

The resolidification can be done by impacting the high temperature treated powder against a surface having a temperature below the solidification temperature of the matrix, in which case a composite material is formed.

8 Claims, 3 Drawing Sheets

ALUMINUM BASED COMPOSITE POWDERS AND PROCESS FOR PRODUCING SAME

BACKGROUND OF THE INVENTION

This invention relates to a composite powdered material having a matrix phase of aluminum or aluminum based alloys and a reinforcement phase of titanium diboride. This invention also relates to a process for producing the composite powdered material in which the titanium diboride is formed in situ as powders containing aluminum, titanium and boron are passed through a high temperature zone. More particularly, the high temperature zone is a plasma.

Aluminum based alloys are relatively light weight low cost materials and thus desirable for use in aerospace applications. Their use however has been limited to low temperature applications because of rapid degradation in their mechanical properties at temperatures above about 250° F. Development of aluminum alloys with adequate mechanical properties at higher temperatures up to about 650° F. would be highly desirable since these could be used to replace more expensive titanium based alloys.

At present, development of these high temperature aluminum alloys is based on two key concepts or technologies. These are (1) rapidly solidified alloys and (2) metal-matrix composites. The first method of rapid solidification is based on the principle that rapid cooling during the solidification process results in refined microstructures and/or supersaturation of the metal matrix with alloying elements resulting in increased precipitation hardening upon using suitable heat treatment. Atomization and melt spinning are two of the techniques used to achieve the high cooling rates. Alloying elements used to impart the desirable high temperature properties have low solubility and diffusivities in the metal matrix and precipitate as intermetallic compounds. Alloys being developed are based on the systems Al-Fe-Ce, Al-Fe-Mo, Al-Ti-Hf, Al-Cr-Zr. etc. High temperature mechanical properties of these rapidly solidified alloys is dependent on the thermal stability of the precipitated phases. Though the improvements in the high temperature mechanical properties of the advanced powder metallurgy aluminum based alloys has been impressive, they still lack specific strength equivalency with titanium based alloys.

The second method of producing high temperature high strength aluminum based materials is based on the composite approach. The reinforcement phase has high strength and high hardness and is typically an oxide, carbide, and/or a nitride. Typically these phases have very high melting points and are thermally stable in the alloy matrix. They are incorporated into the composite system by mechanical mixing with the alloy powders. Discontinuously reinforced aluminum alloys fabricated via powder metallurgy processing represent a maturing technology offering aluminum based alloys having improved specific stiffness and strength at only a slight increase in density. Silicon carbide whisker or particulate-reinforced aluminum alloys are fabricated using the composite approach. The process for fabricating whisker reinforced materials on a commercial basis has been developed by ARCO Metal's Silag Operation. A process for making particulate-reinforced aluminum alloys has been developed by DWA Composites Incorporated. It utilizes a binder to make green "pancakes" of SiC and aluminum powders which are then stacked prior to hot pressing. U.S. Pat. No. 4,259,112, Dolowy, J. F., Webb, B. A., and Suban E. C., Mar. 31, 1981. While the preliminary steps to fabricate the green shapes to be hot pressed are somewhat different, both ARCO and DWA processes involve vacuum hot pressing slightly above the solidus to achieve full densification of billet and plate. Subsequent extrusion or forging of the billet is necessary to optimize mechanical properties. The apparent need to hot press at a temperature above the solidus temperature of the alloy (that is, the alloy is partially remelted) to achieve wetting of the SiC reinforcement is a limitation of the process, since the solidification rate experienced by the remelted matrix is comparatively much slower than that of the starting powder material in the metal matrix. Thus the melting and resolidification cycle used in the process destroys the desirable rapidly solidified structure of the starting powder. The resulting alloy segregation can be deleterious in terms of the mechanical properties of the matrix and hence of the composite system.

Another composite technique called "compocasting" involves adding non-metals to partially solidified alloys. The high viscosity of the metal slurry prevents particles from settling, floating, or agglomerating. Bonding of non-metal to metal is accomplished by interaction between the respective particles. Mehrabian, R., Riek, R. G., and Flemings, M. C., "Preparation and Casting of Metal-Particulate Non-Metal Composites", Metall. Trans., 5(1974) 1899–1905 and Mehrabian, R., Sato, A., and Flemings, M. C., "Cast Composites of Aluminum Alloys", Light Metals, 2(1975) 177–193. The cooling rates experienced by the metal-matrix are again low, comparable to other casting techniques ($10^{-3}$ to 1 k/s).

Still another method for producing powder metallurgy composite materials is by mechanical alloying. This is essentially a high energy ball milling operation which is done typically in a stirred ball mill called an attritor mill. High strength material results from mechanically working the alloy because of incorporation of oxides and carbides during the milling, and because of strengthening mechanisms due to severe working resulting in fine grain and sub fine grain size.

U.S. Pat. Nos. 3,909,241 and 3,974,245 relate to processes for producing free flowing powders by agglomerating finely divided material, classifying the agglomerates to obtain a desired size range, entraining the agglomerates in a carrier gas, feeding the agglomerates through a high temperature plasma reactor to cause at least partial melting of the particles, and collecting the particles in a cooling chamber containing a protective gaseous atmosphere, wherein particles are solidified.

SUMMARY OF THE INVENTION

In accordance with one aspect of this invention, there is provided composite powder particles which are essentially spherical in shape and which consist essentially of particles of a matrix phase which consists esentially of a metal selected from the group consisting of aluminum and aluminum based alloys and a reinforcement phase which is relatively uniformly dispersed in and bonded to the matrix, the reinforcement phase comprising titanium diboride.

In accordance with another aspect of this invention, there is provided a process for producing the above composite particles which involves entraining in a carrier gas a plurality of agglomerated powders, at least one of the powders supplying aluminum, at least one of the powders supplying titanium without boron and at least one of the powders supplying boron without titanium. The powders are fed through a high temperature zone to cause essentially complete melting and coalescence of the powders wherein at least a part of the titanium and at least a part of the boron combine to form titanium diboride and thereafter resolidified to form the composite powder.

In accordance with still another aspect of the invention, the resolidification can be done by impacting the high temperature treated powder against a surface having a temperature below the solidification temperature of the matrix, in which case a composite material is formed.

DETAILED DESCRIPTION OF THE INVENTION

Figure 1A:
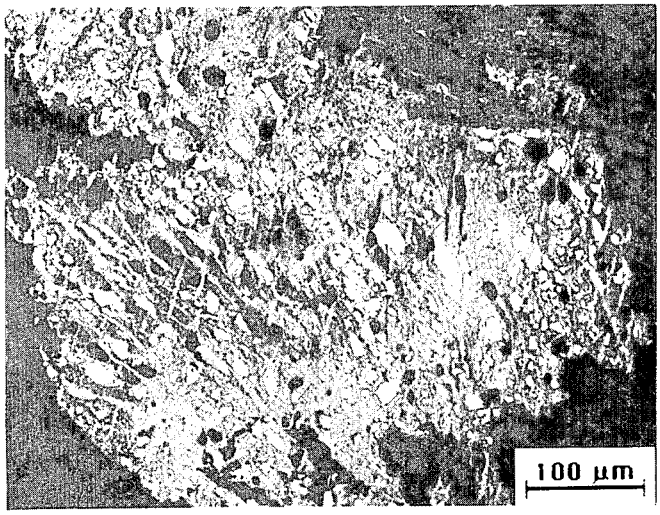
FIGS. 1*a* and 1*b* show typical cross sectional microstructures of the starting materials: (a) Al-10% by weight Ti, and (b) Al-4% by weight B.

For a better understanding of the present invention, together with other and further objects, advantages, and capabilities thereof, reference is made to the following disclosure and appended claims in connection with the above described figures and description of some of the aspects of the invention.

At least one of the starting powders supplies aluminum, and at least one of the powders supplies titanium without boron, and at least one of the powders supplies boron without titanium. The relative amounts of titanium and boron are sufficient so that in the subsequent step of passing through the high temperature zone, titanium diboride is formed. The starting powders can be preblended in a variety of combinations, for example, (1) Al powder - Ti powder - B powder, (2) Al-Ti powder, Al-B powder, (3) Al-Ti powder, B powder, and (4) Al-B powder, Ti powder. In these combinations it can be seen that the Ti and B components of the reinforcement phase are supplied by at least two of the materials. The preferred combination is (2) that is, Al-Ti powder and Al-B powder since the temperatures required to melt the constituent powders is lowest of all the listed combinations.

The starting powders are first agglomerated. The agglomeration is done by standard techniques, such as by spray drying or air drying a slurry of a binder and the powders.

In accordance with a preferred embodiment of this invention, the agglomerated powder particles are dewaxed by standard methods to remove the binder if deemed necessary before further processing.

The agglomerates are sintered by standard methods to impart sufficient strength to the particles for subsequent operations.

It is preferred that the agglomerated particles be classified to obtain the desired particles size ranges.

The agglomerated particles are entrained in a carrier gas which is preferably argon.

The agglomerated particles entrained in the carrier gas are fed through a high temperture zone which is at a temperature above the melting point of aluminum and below the vaporization temperature of the elements contained in the powders for a sufficient time to cause essentially complete melting of the powders and coalescence of the particles of the powders and to react titanium and boron to form titanium diboride.

The resulting high temperature treated powder particles are then resolidified to form the composite powder wherein the matrix phase can be aluminum and aluminum based alloys and the reinforcement phase contains titanium diboride.

The source for the high temperature zone can be a plasma such as a DC or RF or a flame spray gun. The preferred high temperature source is a DC plasma gun.

In accordance with a preferred embodiment, the agglomerates are injected into the hot plasma jet using a carrier gas. The alloy particles forming the agglomerates are melted and coalesce. The titanium and boron are dissolved in the molten aluminum and react to form titanium diboride. As the molten agglomerates resolidify additional phases such as AlTi, $Al_3Ti$, and $AlB_2$ can form depending on the alloy chemistry. Upon complete resolidification, the resulting composite powder particles are essentially spherical in shape, fully dense with a very fine dispersion of the insitu formed titanium diboride reinforcement phase. Other phases can be present in the reinforcement phase such as $Al_3Ti$. The typical size of the composite particles is from about 50 to about 200 micrometers in diameter. The typical size of the reinforcement phase particles is in the submicron to a few microns range, typically less than about 10 microns. By controlling the relative amounts of the starting materials, different phases and volume fractions of different phases can be formed in the reaction. For example in the Al-Ti-B system, $TiB_2$ is thermodynamically the most stable phase. By adding B over and above the amount needed to form $TiB_2$, $TiB_2$ forms and then $AlB_2$ forms. By adding Ti over and above the amount needed to form $TiB_2$, $TiB_2$ forms then $Al_3Ti$ forms. Thus, by controlling the Ti/B ratio different phases can be formed. In the discussed system $TiB_2$ is the most stable phase and forms leaving the matrix aluminum system with very low amounts of dissolved Ti and B when added in stoichiometric ratio. The stoichiometric ratio of Ti to B in $TiB_2$ is 1 to 2. This represents a weight ratio of Ti to B of about 2.215 to 1.

A typical plasma gun incorporates a conical thoriated tungsten cathode, a water-cooled annular copper anode which also serves as a nozzle, a gas injection system and a powder injection system system. Gases used are selected for inertness and/or energy content. These include argon, hydrogen, helium, and nitrogen. Plasma gun operating power levels are generally in the 15 to 80 kW range. The location of the power injection port varies with the nozzle design and/or the powder material. It is either in the nozzle (anode) throat or downstream of the nozzle exit.

The plasma jet is not a uniform heat source. It exhibits steep temperature (enthalpy) and velocity gradients which determine the velocity and temperature achieved by the injected powder particles (agglomerates). In addition, the particle trajectories (and hence the temperature and velocity) are affected by the particle size, shape, and thermophysical properties. The particle temperature is controlled by appropriately selecting the plasma operating conditions (plasma gas composition and flow rate and plasma gun power) and the injection parameters (injection port location and carrier gas flow rate.

The resolidification step can be accomplished by several methods.

In accordance with the preferred embodiment, the resolidification is done by allowing the resulting high temperature treated particles to travel out of the high temperature zone to a cooler zone having a temperature below the solidification temperature of the matrix phase to allow the matrix to resolidify.

The resolidification can be done also be impacting the resulting high temperture treated particles onto a solid substrate or into a liquid medium wherein the resolidification of the matrix takes place after the impact. In the case of impact with a solid substrate, a deposit of the composite material results.

A characteristic feature of the process of the present invention is that the insitu precipitation of solid reinforcement phase is carried out by bringing together its separate components which are in a liquid state (dissolved in the liquid metal or alloy matrix phase). After the reaction in the plasma jet, the remaining liquid resolidifies in flight as the melted agglomerates cool. The result is a composite powder with a very fine and homogeneous dispersion of the reinforcement phase.

The concept of using a liquid metal bath to react dissolved elements to form a new phase is known. The process is known by various names such as: the "menstrum process" or the McKenna process. The process is generic in nature and has been used for the production of hard compounds such as carbides, borides, silicides, nitrides, and carbonitrides (R. Kieffer and G. Jangg: Powder metallurgy International, Vol. 4, No. 4, 1972, pp. 191–192), (R. Kieffer and H. Rassaerts, Int. J of Powder Metallurgy, Vol. 2, No. 2, 1966, pp. 15–22), B. Champaigne, S. Dallaiare and A. Adnot: J. of Less Common Metals, (14), 1968, pp L21–L25). In these processes the formed reaction product is separated from the liquid metal bath. U.S. Pat. No. 4,540,546 discloses a melting process which is essentially the same as the Menstrum or McKenna process. The primary difference relates to the subsequent melt spinning or gas atomization process. U.S. Pat. No. 4,540,546 does not address technical difficulties which can arise from melt crucible reactions and the ability to obtain precise and controlled pour rates through both crucible nozzles. Such pour rate inconsistencies can result in a non-homogeneous product. In contrast, the process as disclosed in this invention the reaction is carried out in a micro "metal bath". The product is approximately the same size as the starting agglomerates, that is, from about 25 to about 200 micrometers. The process does not require any subsequent operations such as atomization or melt spinning to make fine powder particles. Carrying the reaction out in a large metal bath also does not lead to rapid cooling of the metal matrix and is thus not suitable for making advanced composites with a rapidly solidified matrix. Carrying out the insitu reaction based on the same principles as in the "auxiliary bath" process in smaller quantities, that is, in small melted agglomerates as described in this invention leads to a very fine reaction product as well as a rapidly solidified matrix.

The composite powders made by the process of this invention can be consolidated to net shape using conventional powder metallurgy techniques such as pressing and sintering, isostatic pressing, forging, extrusion, and combinations thereof.

To more fully illustrate this invention, the following nonlimiting example is presented.

EXAMPLE

Figure 1B:
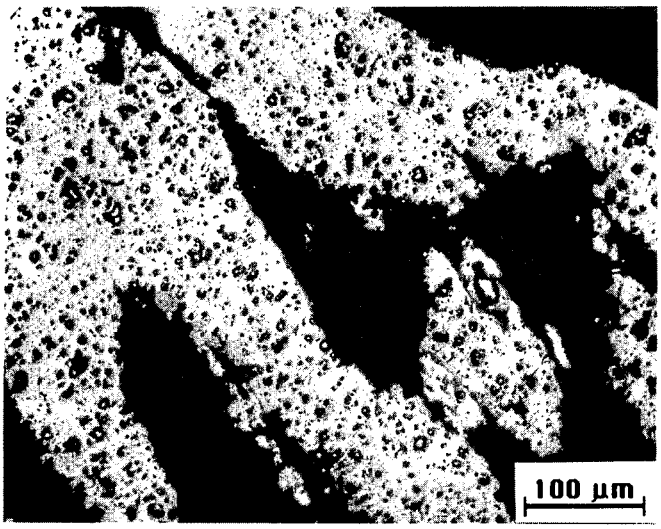
Figure 2:
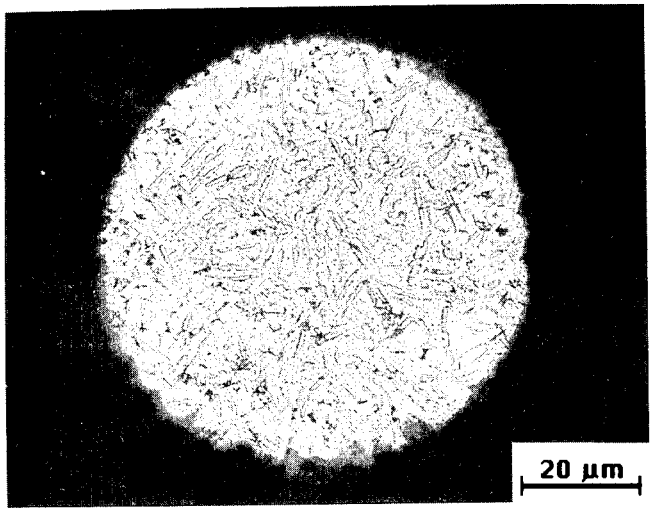
FIG. 2 shows the cross sectional microstructures of the composite powders made by the process of this invention.

Aluminum metal powder containing about 10% by weight titanium and aluminum powder containing about 4% by weight boron are used as the starting powders in this example. The above powders are agglomerated by air drying in a tray a slurry of the powders, polyvinyl butyral as a binder supplied by Monsanto under the trade name of Butvar B-76, and ethyl alcohol as the liquid slurry medium. The binder content is about 2% by weight of the total powder charge. The resulting tray dried agglomerates are then dewaxed and sintered in a hydrogen furnace. The dewaxing temperature and time are about 400° C. and about 4 hours respectively. Sintering is carried out at about 600° C. for about 4 hours. The agglomerates are then slowly cooled to room temperature. The dewaxed and sintered agglomerates are then screened into different size ranges. Agglomerates in the size range of from about 75 to about 90 micrometers are melted using a D.C. plasma torch. A mixture of argon and hydrogen is used as the plasma gas with the argon flow rate at about 20 l/min. and the hydrogen flow rate at about 1.5 l/min. The power is about 25 kW. A 1.75 mm diameter injection port at the nozzle exit is used for injecting the powder aggomerates into the plasma jet. Argon at a flow rate of about 1.5 l/min. is used as the carrier gas. The melted agglomerates are then collected at the chamber bottom and analyzed using x-ray diffraction analysis, the results of which show peaks corresponding to Al, $TiB_2$, and $Al_3Ti$. Typical cross sectional microstructures of the respective starting material, that is, (a) Al-10% by weight Ti, and (b) Al-4% by weight B are shown in FIG. 1. The cross sectional microstructure of the resulting composite powder is shown in FIG. 2. It is evident from these micrographs that the resulting powder has a refined microstructure and the reinforcement phases of $TiB_2$ and $Al_3Ti$ are very fine and well dispersed.

While there has been shown and described what are at present considered the preferred embodiments of the invention, it will be obvious to those skilled in the art that various changes and modifications may be made therein without departing from the scope of the invention as defined by the appended claims.

What is claimed is:

1. Composite powder particles consisting essentially of particles of a matrix, said matrix consisting essentially of a metal selected from the group consisting of aluminum and aluminum based alloys and a reinforcement phase which is relatively uniformly dispersed in and bonded to said matrix, said reinforcement phase comprising titanium diboride, said composite particles being essentially spheres.

2. A process for producing composite powder particles consisting essentially of a matrix phase and a reinforcement phase, said process comprising:

(a) entraining in a carrier gas a plurality of agglomerated powders with at least one of said powders supplying aluminum, at least one of said powders supplying titanium without boron and at least one of said powders supplying boron without titanium;

(b) feeding said powders through a high temperature zone to cause essentially complete melting and coalescence of said powders wherein at least a part of said titanium and at least a part of said boron combine to form titanium diboride; and (c) resolidifying the resulting high temperature treated powder particles to form said composite powder wherein said matrix phase is selected from the group consisting of aluminum and aluminum based alloys and said reinforcement phase comprises titanium diboride.

3. A process of claim 2 wherein said high temperature zone is a plasma.

4. A process of claim 2 wherein prior to being fed through said high temperature zone said agglomerated powders are dewaxed, sintered and classified.

5. A process of claim 2 wherein said resolidification is done by allowing the resulting high temperature treated powder particles to pass out of said high temperature zone and into a cooler zone having a temperature below the solidification temperature of said matrix phase.

6. A process for producing a composite material consisting essentially of a matrix phase and a reinforcement phase, said process comprising:

(a) entraining in a carrier gas a plurality of agglomerated powders with at least one of said powders supplying aluminum, at least one of said powders supplying titanium without boron and at least one of said powders supplying boron without titanium;

(b) feeding said powders through a high temperature zone to cause essentially complete melting and coalescence of said powders wherein at least a part of said titanium and at least a part of said boron combine to form titanium diboride; and (c) resolidifying the resulting high temperature treated powder particles to form said composite material wherein said matrix phase is selected from the group consisting of aluminum and aluminum based alloys and said reinforcement phase comprises titanium diboride, said resolidification being done by impacting the resulting high temperature treated particles against a surface having a temperature below the solidification temperature of said matrix phase.

7. A process of claim 6 wherein said high temperature zone is a plasma.

8. A process of claim 6 wherein prior to being fed through said high temperature zone said agglomerated powders are dewaxed, sintered and classified.

* * * * *